US006869275B2

(12) United States Patent
Dante et al.

(10) Patent No.: US 6,869,275 B2
(45) Date of Patent: Mar. 22, 2005

(54) PIEZOELECTRICALLY DRIVEN FLUIDS PUMP AND PIEZOELECTRIC FLUID VALVE

(75) Inventors: Henry M. Dante, Midlothian, VA (US); Hector Alonso, Richmond, VA (US); A. Clifton Lilly, Jr., Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 51 days.

(21) Appl. No.: 10/073,953

(22) Filed: Feb. 14, 2002

(65) Prior Publication Data

US 2003/0152469 A1 Aug. 14, 2003

(51) Int. Cl.[7] ..... F04B 17/03

(52) U.S. Cl. ..... 417/413.2; 417/322; 417/478; 417/505; 417/413.2; 251/4; 251/7; 251/129.06

(58) Field of Search ..... 417/322, 413.2, 417/478, 505; 251/4, 7, 129.06

(56) References Cited

U.S. PATENT DOCUMENTS

| | | | | |
|---|---|---|---|---|
| 3,029,743 A | * | 4/1962 | Johns | 417/322 |
| 3,270,672 A | | 9/1966 | Haines et al. | |
| 3,963,380 A | | 6/1976 | Thomas, Jr. et al. | |
| 4,432,699 A | | 2/1984 | Beckman et al. | |
| 4,449,893 A | | 5/1984 | Beckman et al. | |
| 4,519,751 A | | 5/1985 | Beckman et al. | |
| 4,553,059 A | | 11/1985 | Abe et al. | |
| 4,555,718 A | | 11/1985 | Aiba et al. | |
| 4,636,149 A | | 1/1987 | Brown | |
| 4,822,250 A | * | 4/1989 | Tsubouchi et al. | 417/45 |
| 4,842,493 A | * | 6/1989 | Nilsson | 417/322 |
| 4,903,732 A | | 2/1990 | Allen | |
| 4,944,659 A | * | 7/1990 | Labbe et al. | 417/413.2 |
| 5,094,594 A | * | 3/1992 | Brennan | 417/413.2 |
| 5,129,789 A | | 7/1992 | Thornton et al. | |
| 5,180,288 A | | 1/1993 | Richter et al. | |
| 5,192,197 A | | 3/1993 | Culp | |
| 5,215,446 A | | 6/1993 | Takahashi et al. | |
| 5,224,843 A | | 7/1993 | van Lintel | |
| 5,261,601 A | | 11/1993 | Ross et al. | |
| 5,705,018 A | | 1/1998 | Hartley | |
| 5,798,600 A | | 8/1998 | Sager et al. | |
| 5,876,187 A | | 3/1999 | Afromowitz et al. | |
| 5,961,298 A | | 10/1999 | Bar-Cohen et al. | |
| 6,042,345 A | * | 3/2000 | Bishop et al. | 417/322 |
| 6,071,087 A | | 6/2000 | Jalink, Jr. et al. | |
| 6,179,584 B1 | * | 1/2001 | Howitz et al. | 417/413.2 |
| 6,179,586 B1 | * | 1/2001 | Herb et al. | 417/480 |
| 6,280,148 B1 | | 8/2001 | Zengerle | |
| 6,280,184 B1 | * | 8/2001 | Hamilton | 433/4 |
| 6,406,605 B1 | | 6/2002 | Moles | |
| 6,450,773 B1 | * | 9/2002 | Upton | 417/53 |
| 6,481,984 B1 | * | 11/2002 | Shinohara et al. | 417/413.2 |

OTHER PUBLICATIONS

Notification of Transmittal of International Preliminary Examination Report for PCT/US03/02747 dated May 25, 2004.

* cited by examiner

*Primary Examiner*—Juntine R. Yu
*Assistant Examiner*—Emmanuel Sayoc
(74) *Attorney, Agent, or Firm*—Burns, Doane, Swecker & Mathis, LLP

(57) ABSTRACT

A piezoelectrically driven fluid pump includes a chamber having two opposite sidewalls formed by flexible membranes, and an inlet and an outlet each regulated by a valve. Separate piezo elements are fixed to each of the membranes, to flex the membranes and increase or reduce the chamber volume and thereby draw fluid into the chamber or expel fluid from the chamber. The valves are each formed by two adjacent piezo elements that are supported or flexibly joined together at two opposite ends. When actuated, the valve piezo elements flex outward between the two opposite ends, opening the valve to form an aperture between the two piezo elements. In another embodiment, a fluid pump includes a chamber having one flexible membrane sidewall. A valve-regulated inlet or outlet aperture through the membrane communicates with the pump chamber. A ring-shaped piezo centered around the aperture, on the membrane, flexes the membrane.

28 Claims, 5 Drawing Sheets

PIEZOELECTRICALLY DRIVEN FLUIDS PUMP AND PIEZOELECTRIC FLUID VALVE

BACKGROUND OF THE INVENTION

1. Field of the Invention

The present invention relates to the field of fluid pumps, and specifically to piezoelectrically driven fluid micro-pumps.

2. Description of Related Art

Piezoelectrically actuated fluid pumps known in the art include a pump configured to have a fluid chamber with one or more sidewalls formed by a membrane. A piezoelectric element attached to an outside surface of the membrane operates the pump. A valve is provided at an inlet to the fluid chamber, and a valve is provided at an outlet from the fluid chamber. When an appropriate voltage potential is applied to the piezo element, the membrane flexes and thereby changes the volume of the chamber, either expelling fluid from the chamber through outlet valve, or drawing fluid into the chamber through the inlet valve. One-way valves and two-way valves are known.

However, a need exists for a piezo-electrically driven fluid pump having increased pumping capacity, and simple, inexpensive and effective controllable valves that enable the pump to operate reliably at high speed and/or with precise flow control.

SUMMARY OF THE INVENTION

In accordance with an exemplary embodiment of the present invention, a piezoelectrically driven fluid pump includes a chamber having two opposite sidewalls formed by flexible membranes, and a chamber inlet and a chamber outlet each regulated by a valve. A plurality of separate piezo elements are fixed to each of the membranes, and when subjected to a voltage potential of appropriate magnitude and polarity, the piezo elements flex the membranes to increase or reduce the chamber volume and thereby draw fluid into the chamber through the inlet, or expel fluid from the chamber via the outlet. The valves that regulate the inlet and the outlet are each formed by two adjacent piezo elements that are supported or joined together at two opposite ends. When voltage potentials of appropriate magnitude and polarity are applied to the adjacent piezo elements of one of the valves, the piezo elements flex or bow outward between the two opposite ends, forming an aperture between the two piezo elements through which fluid may pass. The opposing faces of the two piezo elements are each provided with a membrane to seal the respective piezo element against the fluid. The piezo elements of the valves and the piezo elements fixed to the membrane sidewalls of the chamber are actuated synchronously to provide a desired flow of fluid through the pump.

In accordance with another embodiment of the invention, a piezoelectrically actuated fluid pump includes a chamber having one sidewall formed from a flexible membrane. An aperture through the membrane forms either an inlet or an outlet to the chamber, and a piezo valve having the same configuration as the valves in the first embodiment, is provided at the aperture to regulate fluid flow through the membrane. A ring-shaped piezo is provided on an exterior of the flexible membrane, centered around the aperture, to flex the membrane and alter the volume of the chamber to pump fluid through the chamber.

BRIEF DESCRIPTION OF THE DRAWINGS

The objects and advantages of the present invention will be further understood by reading the following detailed description in conjunction with the drawings, wherein.

DETAILED DESCRIPTION OF THE INVENTION

Figure 1:
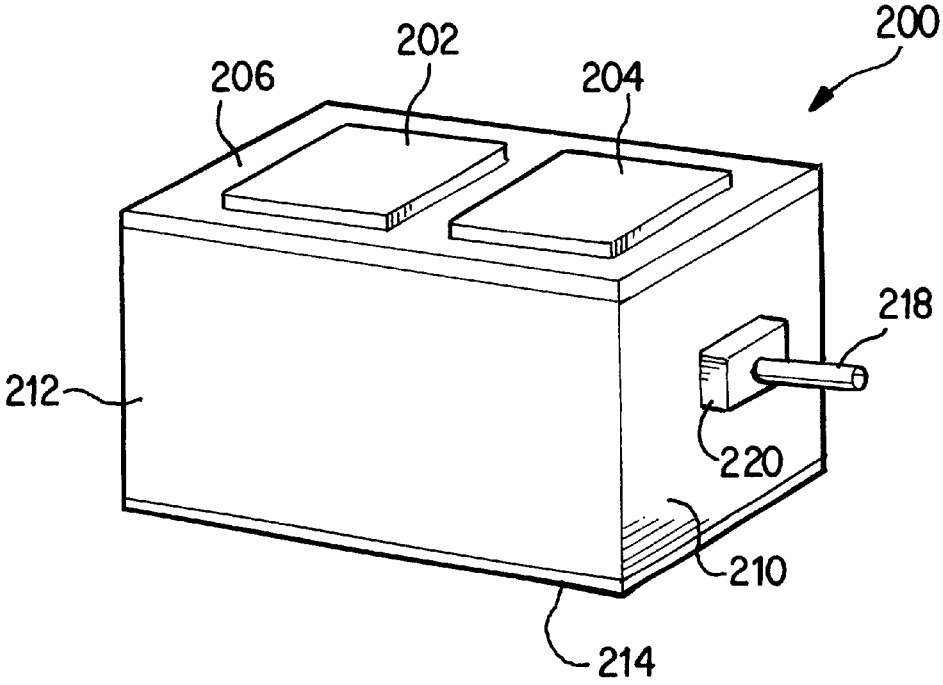
FIG. 1 illustrates a perspective view of a fluid pump in accordance with an exemplary embodiment of the invention.

FIG. 1 shows a perspective view of a first exemplary embodiment of the invention. As shown in FIG. 1, a piezoelectric fluid pump 200 includes a fluid chamber having sidewalls, including rigid sidewalls 212, 210 and two, opposite flexible membrane sidewalls 206, 214. The membrane sidewalls 206, 214 are made of brass.

The membrane sidewalls can alternatively be made of any appropriately flexible material. The membrane can for example, be made of stainless steel, aluminum alloy, fabric (s) such as LEXON™, metallic polymer(s), polyester film (e.g., Mylar™), or any other suitable material. The membrane can be any appropriate thickness. In an exemplary embodiment of the invention, a thickness of the membrane is selected from a range of 20 microns to several hundred microns. In an exemplary embodiment of the invention, the thickness of the membrane is between 25 microns and 100 microns.

In an exemplary embodiment of the invention, the fluid chamber is from a few millimeters to several tens of millimeters long, from a few millimeters to several tens of millimeters wide, and from a fraction of a millimeter to several millimeters thick. In an exemplary embodiment of the invention, the fluid chamber is from 5 mm to 50 mm long, from 5 mm to 30 mm wide, and 2 mm to 5 mm thick.

Figure 5:
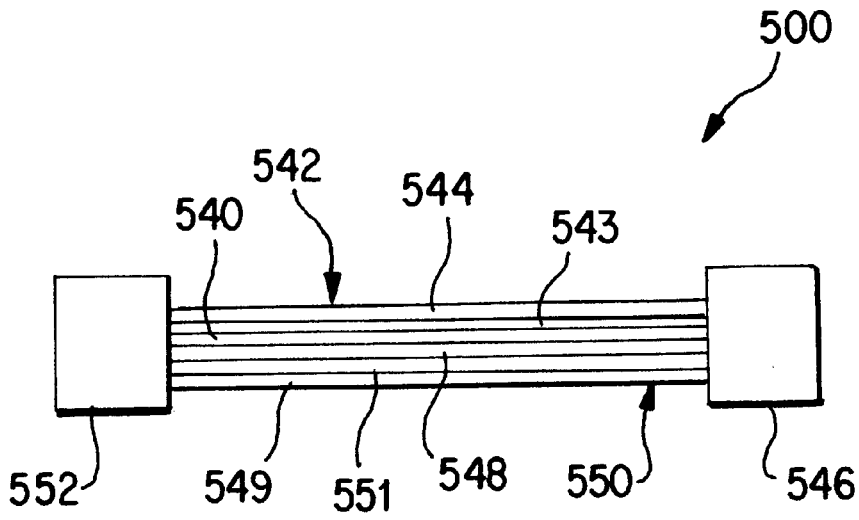
FIG. 5 illustrates an end view of a piezoelectrically actuated valve in accordance with an exemplary embodiment of the invention, as it would be seen in the direction 5—5 indicated in FIG. 2.
Figure 6:
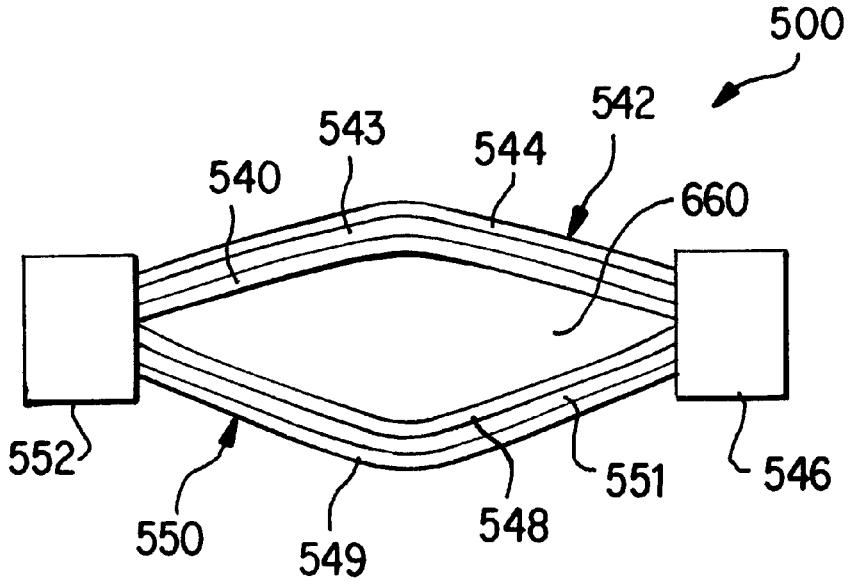
FIG. 6 illustrates the valve shown in FIG. 5, in an open position.

As shown in FIG. 1, separate piezo elements 202, 204 are provided on the membrane 206, to flex the membrane 206 and alter a volume of the pump chamber and thereby move fluid through the chamber. Also shown is a valve unit 220 connected to an outlet fluid tube 218, that communicates via the valve unit 220 with the pump fluid chamber 216. The valve unit 220 passes through or communicates with an outlet through the sidewall 210 of the pump 200. The valve unit 220 includes a piezoelectric valve as shown in FIGS. 5–6 and described further below.

Figure 2:
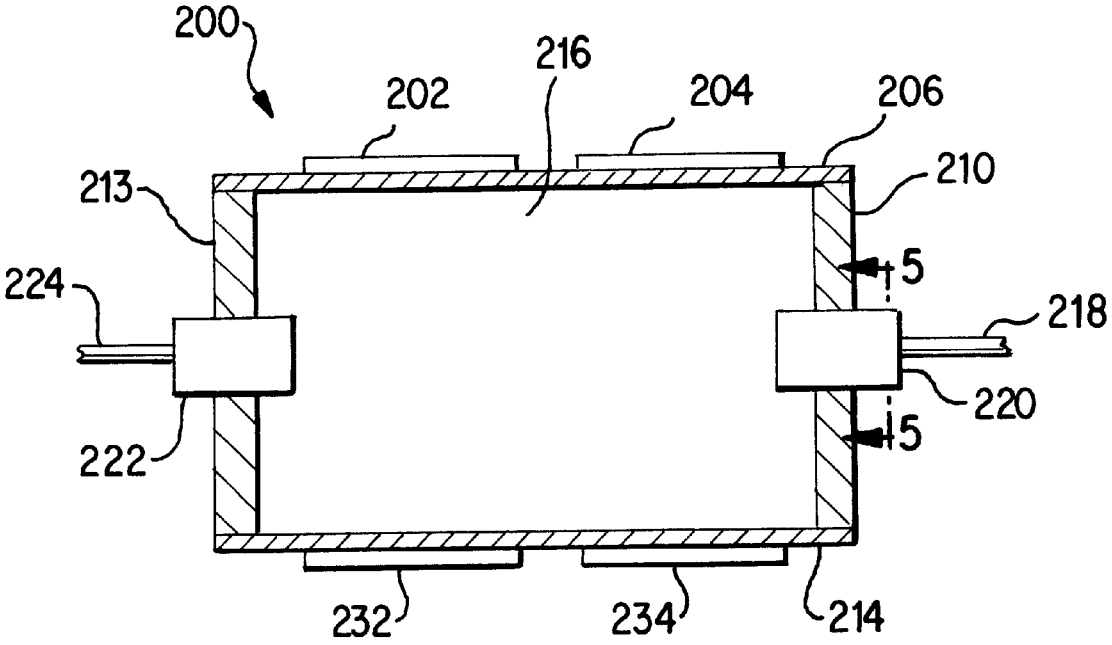
FIG. 2 illustrates a side cross-sectional view of the fluid pump shown in FIG. 1.

FIG. 2 shows a side cross-sectional view of the pump 200 shown in FIG. 1. As shown in FIG. 2, the valve units 220, 222 pass through or communicate with an outlet through the sidewall 210 and with an inlet through the sidewall 213 respectively, as shown in FIG. 2. An inlet fluid tube 224 supplies fluid to the valve unit 222. Piezos 232, 234 are provided on the flexible membrane 214, and operate to flex the membrane 214 in the same fashion as the piezos 202, 204 flex the membrane 206.

Figure 3:
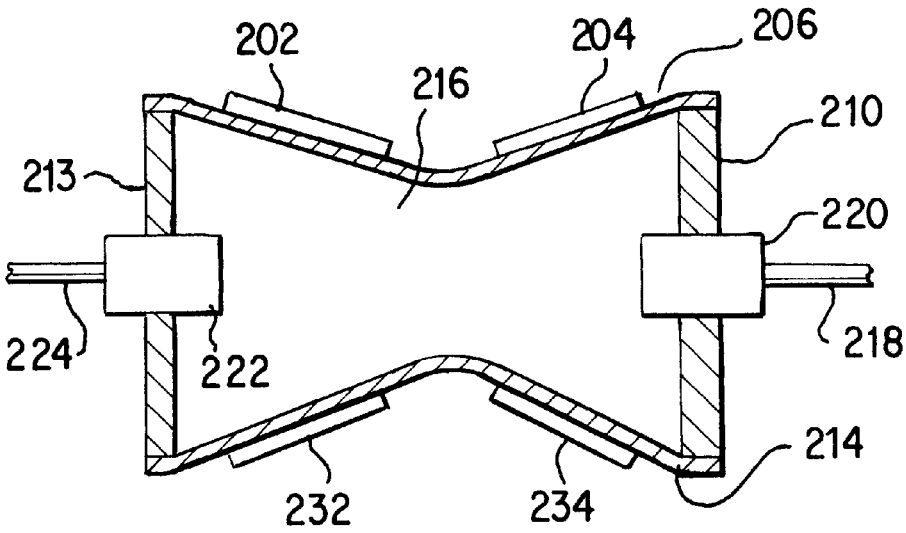
FIG. 3 illustrates the pump of FIG. 2, with the membranes flexed decrease the volume of the fluid chamber and expel fluid from the chamber.
Figure 4:
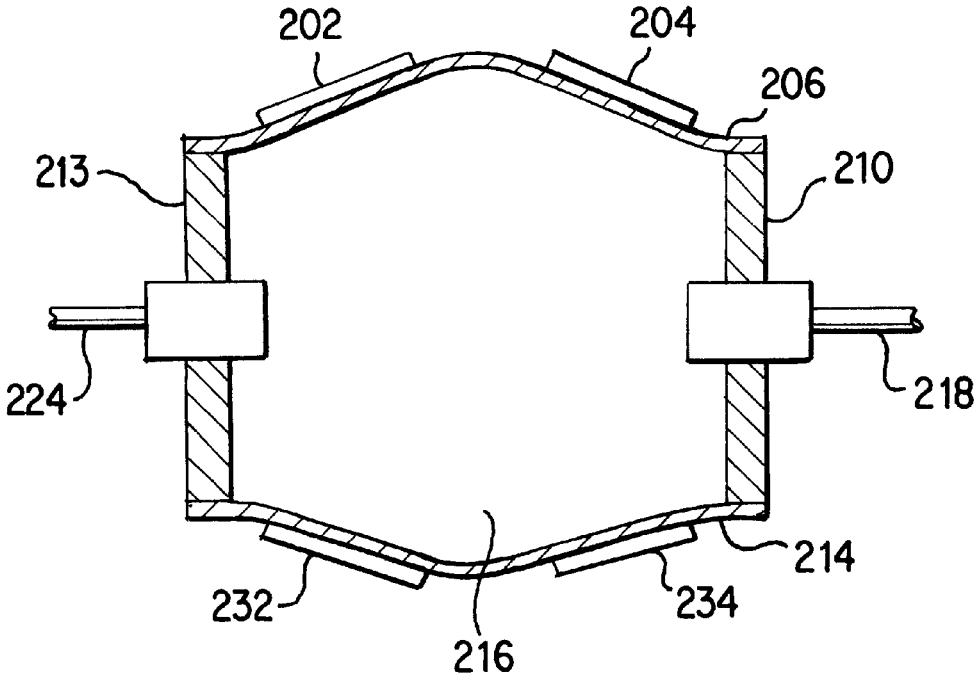
FIG. 4 illustrates the pump of FIG. 2, with the membranes flexed to increase the volume of the fluid chamber and draw fluid into the chamber.

FIGS. 3–4 illustrate operation of the pump 200 when the piezos 202, 204, 232, 234 are actuated. As shown in FIG. 3, when voltage potentials having appropriate polarities and magnitudes are applied to the piezos 202, 204, 232, 234, the piezos 202, 204, 232, 234 flex the membranes 206, 214 inward toward the center of the fluid chamber 216, thereby decreasing the volume of the chamber 216. When the inlet valve unit 224 is closed and the outlet valve unit 220 is open, this decrease in chamber volume will expel fluid from the chamber 216 through the valve unit 220 and into the outlet fluid tube 218.

Appropriate voltage potentials are also applied to the piezos 202, 204, 232, 234 to flex the membranes 206, 214 outward from the center of the chamber 216, thereby increasing the volume of the chamber 216 and drawing fluid into the chamber 216 when the inlet valve unit 224 is open and the outlet valve unit 220 is closed. This can be done from the flexed membrane state shown in FIG. 3, or starting from the quiescent membrane state shown in FIG. 2.

Voltage potentials necessary to successfully operate the pump 200 and/or the valves will be apparent to those of ordinary skill in the art, based on common knowledge of the properties of piezo materials. For example, actuating voltages depend on the thicknesses of the piezo material used. In an exemplary embodiment of the invention where the piezos are between 50 and 250 microns thick, voltages ranging from 25 to 250 volts can be used to actuate both the valves and the pump. Those of ordinary skill in the art will recognize that appropriate voltages can be easily selected depending on the particular configuration and application of the invention.

Each of the two flexible membranes 206, 214 are provided with two separate piezo elements (202, 204 for the membrane 206, and 232, 234 for the membrane 214). This is done deliberately for the following reason. The piezo ceramics are quite hard and brittle and by themselves produce very small deflection. The membranes 206 and 214 are made from materials that are quite flexible and also are very thin so that they can provide large deflections. Thus providing two elements of the piezo strips separated in the middle provides for the piezo elements to produce mostly linear deformation, and allows the membrane segment in between the two piezo elements to produce large deflection by bending in a curved fashion in the middle and the ends as shown in FIGS. 3–4.

Moreover, to generate the high pressure to force the fluid in the pump requires a substantial amount of piezo polarization. This is normally obtained by using thick piezo materials. However, using a single thick piezo strip prevents large deflection. Thus using two thick piezo strips separated by a thin layer of flexible membrane is advantageous as it provides large deflection due to the flexible membrane, and also generates high pressure due to the thick piezo strips. The sizes and locations of the piezo strips 202, 204 (as well as 232, 234) are selected such that the deflection produced by the whole structure upon activation is maximized, thus producing large volume changes in the pump chamber. Those skilled in the art will recognize that more than two piezo elements can be used to give similar results, but using more than two piezo elements generally does not further increase the displacement.

Figure 10:
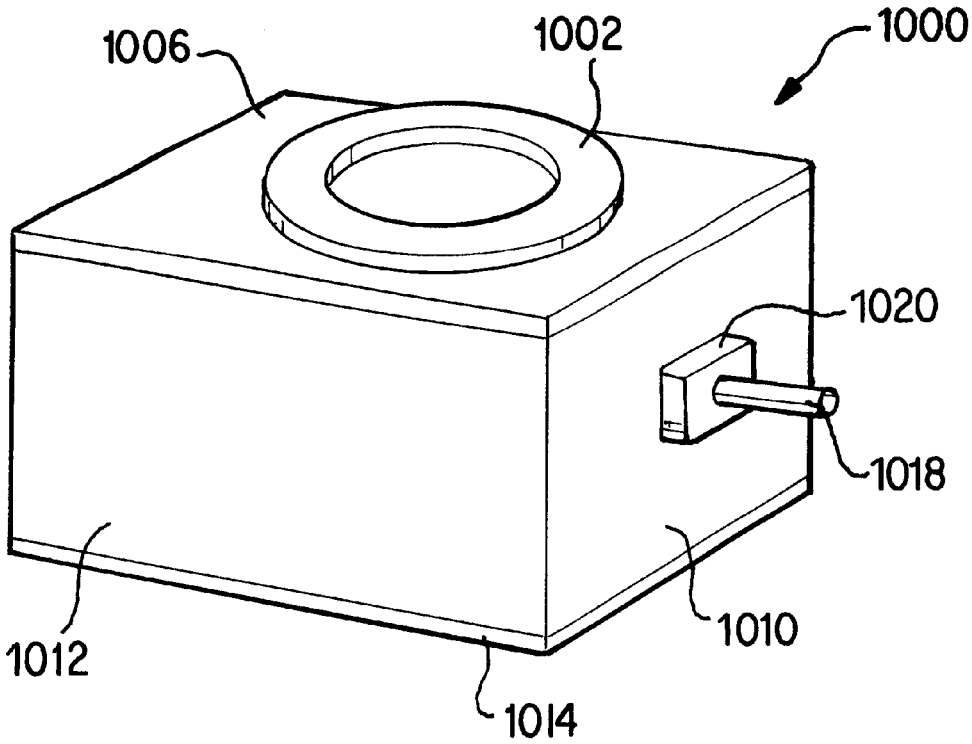
FIG. 10 illustrates a perspective view of a fluid pump in accordance with another exemplary embodiment of the invention.

Another way of achieving large deflection in the membrane is by using an annular or ring-shaped piezo element as the actuator. The deflection of the membrane/piezo combination can be maximized by controlling the inner and outer diameters of the ring. When such a ring actuator is used in the pump, the shape of the pump can be cylindrical with the two circular faces of the cylinder forming the flexible membranes. However, the annular piezo element can also be used in a pump with a rectangular structure, as shown for example in FIG. 10. As shown in FIG. 10, an annular piezo 1002 is located on a sidewall membrane 1006 of a pump 1000. The pump 1000 has another sidewall membrane 1014 on an opposite side end of the sidewall 1012, and a sidewall 1010 between the two membranes 1006, 1014 includes a valve unit 1020. The membrane 1014 also has an annular piezo (not shown). Aside from using an annular piezo on a membrane sidewall instead of two separate piezos as shown for example in FIGS. 1–2, the pump 1000 functions in the same was as the pump 200.

Those skilled in the art will realize that the shape of the pump can be any shape that is appropriate for the specific application at hand, including but not limited to rectangular, cylindrical, polygonal, and so forth. Those skilled in the art will also realize that the shapes of the piezos can vary beyond the rectangular and annular shapes shown in FIGS. 1 and 10, consistent with the application at hand.

The valve units 220, 224 can be controlled to operate the pump 200 in a variety of ways. For example, the pump can be backflushed (e.g., reversed) by bringing the pump from the flexible membrane states shown in either FIG. 2 or FIG. 4, to the membrane states shown in FIG. 3 while keeping the outlet valve unit 220 closed and the inlet valve unit 224 open. In addition, fluid flow can be reversed or oscillated during a single pumping stroke, which could be used to a) aid in flushing or cleaning the fluid pump or fluid bearing elements communicating with the pump, b) take advantage of any resonance effects in the pump or fluid system in which the pump is being used (especially, for example, in situations or implementations where the fluid being pumped is compressible), or c) precisely meter fluid flow (e.g., by stopping or reducing fluid flow at a desired time or level before the pumping stroke, i.e., the movement of the membranes, is complete). This can be done for example by opening the outlet valve unit 220 and closing (or keeping closed) the inlet valve unit 222 before commencing a compression stroke of the membranes 206, 214, and then partway through the compression stroke, closing the outlet valve unit 220 and opening the inlet valve unit 222.

FIG. 5 shows a piezoelectric valve 500 in accordance with an exemplary embodiment of the invention, provided in the valve units 220, 222 for regulating fluid flow into and out of the fluid chamber 216. In particular, FIG. 5 shows an end view of a valve 500 viewed in the direction 5—5 as indicated in FIG. 2. The valve 500 includes two bimorph piezos 542, 550 arranged next to each other and supported at opposite ends by end supports 552, 546. The bimorph piezo 542 is made of two piezo elements 543, 544 bonded together, and the bimorph piezo 550 is made of two piezo elements 549, 551 bonded together. Each of the bimorph piezos is actuated by applying opposite or different polarity voltage potentials to the piezo elements making up the bimorph piezo element, so that one of the elements expands while the other contracts, thus producing a large deflection at the center of the bimorph element relative to the ends of the bimorph element. For example, in FIG. 6 voltage potentials are applied to the outer piezo elements 544, 549 to make them expand, while different voltage potentials are applied simultaneously to the inner piezo elements 543, 551 to make them contract.

Another way of achieving the same result is to polarize the two piezo elements 543 and 544 (as well as the piezo elements 549, 551) with opposite polarization. Now when a voltage is applied between the outer face of the piezo element 543 and the outer face of the piezo element 544 (as well as between the outer face of the piezo element 549 and the outer face of the piezo 551), the structure will deflect with the same result as shown in FIG. 6.

In an exemplary embodiment of the invention, an electrically conductive layer is provided between the two elements of each bimorph piezo to facilitate application of opposite polarity voltage potentials to the elements.

FIGS. 5–6 show membranes 540, 548 arranged on inside opposing surfaces of the bimorph piezos 542, 550. In exemplary configurations, the membranes 540, 548 a) seal and protect the piezos 551, 543 from the fluid being pumped through the pump, and/or b) help to seal the valve aperture 660 when the valve 500 is in the closed position to prevent leakage or backflow of fluid through the closed valve 500. In exemplary configurations the membranes 540, 548 are metallic layers optionally coated with a protective and/or sealing material on the surfaces facing the aperture 660. The membranes can be made from any appropriate material or combination of materials that protects the piezo elements of the valve, and/or provides good sealing of the valve aperture 660 when the valve is in the closed position. In another exemplary embodiment of the invention, the membranes 540, 548 are omitted from the valve 500. The presence or absence of the membranes 540, 548, and the composition of the membranes 540, 548, can be selected and designed based on details of each application. These details include for example the chemical nature of the fluid to be pumped, the viscosity of the fluid, desired flow rates, and so forth. For example, as those skilled in the art will appreciate, some applications tolerate greater fluid leakage or backflow through the valve 500 and therefore allow use of membranes 540, 548 having lesser sealing properties, or allow the membranes to be omitted entirely. Metallic layers can also be provided on the outer surfaces of the piezo layers 544, 550.

FIG. 5 shows the bimorph piezos 542, 550 in a quiescent or relaxed state, with the valve 500 in a closed position. FIG. 6 shows the valve 500 with the bimorph piezos 542, 550 actuated by appropriate voltage potentials to flex or bend away from each other between the supported opposite ends, to open the valve 500 and provide an aperture 660 through which the fluid can flow.

The end supports 552, 546 hold the opposite ends of the bimorph piezos 542, 550 together. In an exemplary embodiment of the invention, the end supports 552, 546 clamp or rigidly fasten together the ends of the bimorph piezos 542, 550. In an exemplary embodiment of the invention, the end supports 552, 546 do not move relative to each other. In another exemplary embodiment of the invention, the end supports 552, 546 move relative to each other as the bimorph piezos 550, 542 flex and the valve aperture 660 opens up.

In another embodiment of the invention, the end blocks of the piezo valve elastically hold the ends of the bimorph piezos together so that all parts of the bimorph piezos can flex while the ends are held together.

In an exemplary embodiment of the invention, the outlet fluid tube from the pump chamber and/or the inlet fluid tube to the pump chamber are resilient, and arranged to pass between the piezos 542, 550, through the aperture 660. Thus when the valve 500 is closed, the piezos 542, 550 pinch the fluid tube flat and thus block the tube. When the valve 500 is open as shown in FIG. 6, then the fluid tube is free to rebound to its tubular shape and allow free passage to fluid flowing through the fluid tube.

In an exemplary embodiment of the invention, the piezos 542, 550 are arranged so that the open position shown in FIG. 6 is the quiescent position of the piezos, and the closed position shown in FIG. 5 occurs when actuating voltage potentials are applied to the piezos 542, 550 to clamp or drive their center sections together.

In an exemplary embodiment of the invention, the valve 500 is placed in the fluid path of the inlet fluid tube or the outlet fluid tube of the pump, distant from the fluid chamber instead of at the fluid chamber walls.

In an exemplary embodiment of the invention, the magnitude, polarity and duration of an electric voltage potential applied to the piezos 542, 550, can be modulated to control the size of the aperture 660. In other words, the size of the aperture 660 can be controlled or modulated using the voltage potentials applied to the piezos 542, 550, so that the aperture is partially opened, is opened or closed in stages, and so forth. In another exemplary embodiment of the invention, the valves in the valve units 220, 222 can be automatic, passive one-way valves that do not require actuation or contain piezo elements.

Figure 7:
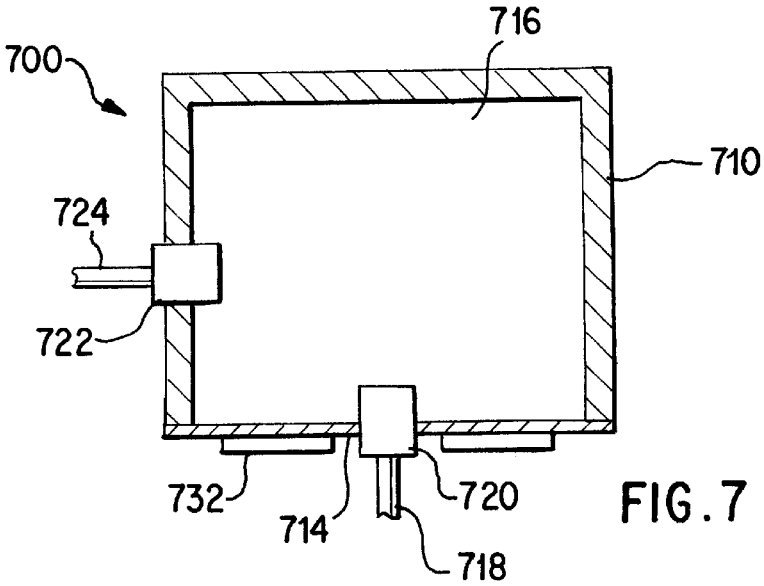
FIG. 7 illustrates a side cross-sectional view of a fluid pump in accordance with another embodiment of the invention, having an aperture through a flexible sidewall of the pump chamber.

FIG. 7 illustrates a pump 700 in accordance with another exemplary embodiment of the invention. As shown in FIG. 7, the pump 700 includes rigid chamber sidewalls 710 and a single flexible sidewall formed by a membrane 714. The membrane 714 includes a valve unit 720 at an aperture through the membrane 714, with an outlet fluid tube 718 leading from the valve unit 720. The membrane 714 and the valve units 720, 722 are similar to the membrane chamber sidewalls and valve units described above with respect to FIGS. 1–6, and can made of the same materials, can have the same design, and function in the same way. For example, the inlet fluid tube 724 can be the same as the inlet fluid tube 224, and the piezo 732 can function in a similar fashion to the piezos 202, 204, to deflect the membrane 714 inward toward a center of the fluid chamber 716, and/or outward away from the center of the fluid chamber 716. However, as can be seen from FIG. 7, the pump 700 differs from the previously described pump embodiments in that fluid exits the pump chamber 716 through the membrane 714.

Figure 8:
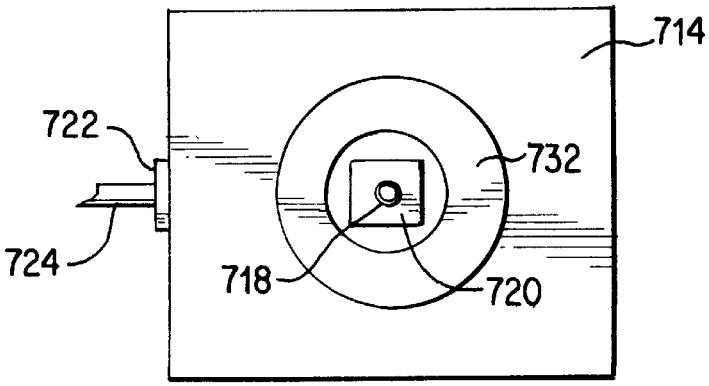
FIG. 8 illustrates a bottom view of the fluid pump shown in FIG. 7, with a ring-shaped piezoelectric element arranged on the flexible sidewall.
Figure 9:
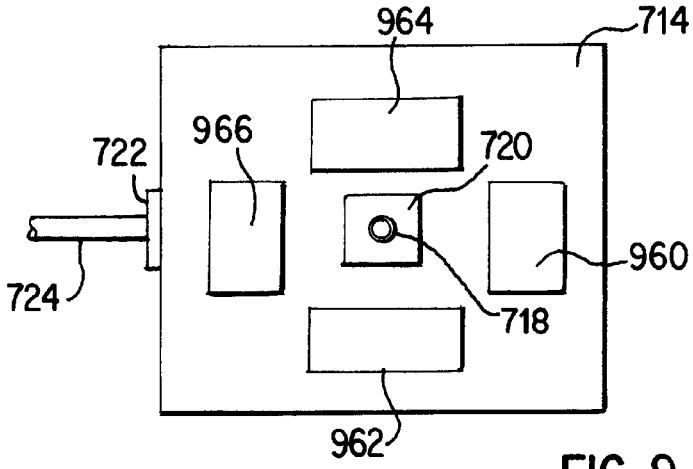
FIG. 9 illustrates a bottom view of a version of the fluid pump shown in FIG. 7, with separate piezoelectric elements arranged on the flexible sidewall instead of the ring-shaped piezoelectric element.

In addition, the piezo 732 has an annular configuration as shown in FIG. 8, centered on the membrane 714 around the valve unit 720. In another embodiment of the invention, instead of providing the annular piezo 732, multiple piezos can be provided on the membrane 714 to flex the membrane and alter a capacity of the fluid chamber 716. For example, piezos 966, 964, 960, 962 can be provided on the membrane 714 as shown in FIG. 9.

In an exemplary embodiment of the invention, the valves in the valve units 722, 720 can be automatic one-way valves that do not require actuation or contain piezo elements.

The chambers of the pumps shown in the Figures are shown as having a primarily rectangular shape. In accordance with other embodiments of the invention, the chamber can have a different shape, for example a cylindrical shape (with either the flat ends or the curved surface of the cylinder being formed of flexible membrane material that can be flexed to alter a capacity of the chamber), a polygonal shape, or any other appropriate shape.

Although a single inlet and a single valve inlet unit and a single outlet and a single outlet valve unit are shown in the Figures, in accordance with other embodiments of the invention the chamber of the pump includes multiple inlets and inlet valves and/or multiple outlets and outlet valves.

The speed, force and magnitude of deflection of the membranes forming flexible sidewalls shown in the Figures can be modulated or selected by modulating the polarity, magnitude and duration of the voltage potential applied to the piezos that deflect the membranes. Electrical connections to the piezos mounted on the flexible sidewalls and in the valve of FIGS. 5–6 are not shown in the Figures. In exemplary embodiments of the invention, the flexible membranes on which the piezos are mounted, are electrically conductive so that the membranes can be connected to one of a ground potential, a positive voltage and a negative voltage, and another of the ground potential, positive voltage and the negative voltage can be applied directly to each piezo (for example, on an opposite side of the piezo) by one or more leads to actuate the piezo. In exemplary embodiments of the invention, an electrically conductive layer can be provided on all or part of a surface of a membrane on which an actuating piezo is mounted to provide electrical connection to the piezo, for example a metallized layer on a Mylar™ membrane. In exemplary embodiments of the invention, electrical connections to the piezos are provided in accordance with techniques, structures and configurations known in the art.

Any appropriate piezoelectric material or piezoelectric actuator or piezoelectric servo can form the piezos variously shown in the Figures and described above.

The present invention has been described with reference to exemplary embodiments. However, it will be readily apparent to those skilled in the art that it is possible to embody the invention in specific forms other then those described above without departing from the spirit of the invention. The various aspects and exemplary embodiments are illustrative, and they should not be considered restrictive in any way. The scope of the invention is given by the appended claims, rather than the preceding description, and all variations and equivalence thereof which fall within the range of the claims are intended to be embraced therein.

What is claimed is:

1. A fluid pump, comprising:

a fluid reservoir;

a first membrane forming a first side of the reservoir;

a first piezoelectric element attached to the first membrane;

a fluid inlet into the reservoir;

a fluid outlet from the reservoir;

a first piezoelectric valve arranged to regulate fluid flow through the fluid inlet; and a second piezoelectric valve arranged to regulate fluid flow through the fluid outlet;

wherein each of the first and second piezoelectric valves comprises two adjacent piezoelectric valve elements that are supported at first and second opposite ends and wherein opposing inner surfaces of the two adjacent piezoelectric valve elements are in continuous contact with each other from the first opposite end to the second opposite end when the piezoelectric valve is closed.

2. The fluid pump of claim 1, wherein the two adjacent piezoelectric valve elements are supported by a first support element at the first end and a second support element at the second end.

3. The fluid pump of claim 2, wherein each of the two adjacent piezoelectric valve elements is a bimorph piezoelectric element.

4. The fluid pump of claim 2, wherein the first and second opposite ends of the two adjacent piezoelectric valve elements are jointly supported by the first and second support elements.

5. The fluid pump of claim 2, wherein when actuated, the two adjacent piezoelectric valve elements flex away from each other between the first and second opposite ends.

6. The fluid pump of claim 2, wherein when actuated, the two adjacent piezoelectric valve elements flex toward each other between the first and second opposite ends.

7. The fluid pump of claim 2, wherein the first and second support elements restrict movement of the first and second opposite ends of the two adjacent piezoelectric valve elements.

8. The fluid pump of claim 7, wherein when the two adjacent piezoelectric valve elements are flexed away from each other between the first and second opposite ends, the valve is open; and when the two adjacent piezoelectric valve elements are flexed toward each other between the first and second opposite ends, the valve is closed.

9. The fluid pump of claim 1, comprising at least two separate piezoelectric elements attached to the first membrane.

10. The fluid pump of claim 9, wherein when actuated with a first voltage polarity, the at least two separate piezoelectric elements flex the first membrane toward a center of the fluid reservoir.

11. The fluid pump of claim 10, wherein when actuated with a second voltage polarity, the at least two separate piezoelectric elements flex the first membrane away from a center of the fluid reservoir.

12. The fluid pump of claim 9, comprising:

a second membrane forming a second side of the reservoir; and at least two separate piezoelectric elements attached to the second membrane.

13. The fluid pump of claim 12, wherein when actuated, the at least two separate piezoelectric elements attached to the second membrane flex the second membrane toward a center of the fluid reservoir.

14. The fluid pump of claim 12, wherein when actuated, the at least two separate piezoelectric elements attached to the second membrane flex the second membrane away from a center of the fluid reservoir.

15. A fluid pump, comprising:

a fluid reservoir;

a first membrane forming a first side of the reservoir;

a first piezoelectric element attached to the first membrane;

a fluid inlet into the reservoir;

a fluid outlet from the reservoir;

a first piezoelectric valve arranged to regulate fluid flow through the fluid inlet; and a second piezoelectric valve arranged to regulate fluid flow through the fluid outlet;

wherein each of the first and second piezoelectric valves comprises two adjacent piezoelectric valve elements that are supported at first and second opposite ends, and wherein the fluid outlet forms a passage through the first membrane.

16. The fluid pump of claim 15, wherein the second piezoelectric valve is arranged on the first membrane.

17. A fluid pump, comprising:

a fluid reservoir;

a first membrane forming a first side of the reservoir;

a first piezoelectric element attached to the first membrane;

a fluid inlet into the reservoir;

a fluid outlet from the reservoir;

a first piezoelectric valve arranged to regulate fluid flow through the fluid inlet; and a second piezoelectric valve arranged to regulate fluid flow through the fluid outlet;

wherein the first and second piezoelectric valves each comprise two adjacent piezoelectric valve elements that are supported at first and second opposite ends, and wherein the first piezoelectric element has a ring shape.

18. The fluid pump of claim 1, further comprising a second piezoelectric element attached to the first membrane, wherein the first and second piezoelectric elements are separate.

19. A piezoelectric valve arranged to regulate fluid flow through the valve, comprising:

two adjacent piezoelectric elements that are supported at first and second opposite ends, wherein opposing inner surfaces of the two adjacent piezoelectric valve elements are in continuous contact from the first opposite end to the second opposite end when the piezoelectric valve is closed.

20. The piezoelectric valve of claim 19, wherein the two adjacent piezoelectric elements are supported by a first support element at the first end and a second support element at the second end.

21. The piezoelectric valve of claim 20, wherein each of the two adjacent piezoelectric elements is a bimorph piezoelectric element.

22. The piezoelectric valve of claim 20, wherein the first and second opposite ends of the two adjacent piezoelectric elements are jointly supported by the first and second support elements.

23. The piezoelectric valve of claim 20, wherein when actuated, the two adjacent piezoelectric elements flex away from each other between the first and second opposite ends.

24. The piezoelectric valve of claim 20, wherein when actuated, the two adjacent piezoelectric elements flex toward each other between the first and second opposite ends.

25. The piezoelectric valve of claim 20, wherein the first and second support elements restrict movement of the first and second opposite ends of the two adjacent piezoelectric elements.

26. The piezoelectric valve of claim 25, wherein when the two adjacent piezoelectric elements are flexed away from each other between the first and second opposite ends, the valve is open; and when the two adjacent piezoelectric are flexed toward each other between the first and second opposite ends, the valve is closed.

27. The piezoelectric valve of claim 1, wherein the opposing inner surfaces of the two adjacent piezoelectric elements comprise membranes that seal the valve when the valve is in the closed position.

28. The piezoelectric valve of claim 19, wherein the opposing inner surfaces of the two adjacent piezoelectric elements comprise membranes that seal the valve when the valve is in the closed position.

* * * * *